US007059285B2

(12) United States Patent
Schäfer et al.

(10) Patent No.: US 7,059,285 B2
(45) Date of Patent: Jun. 13, 2006

(54) CONTROL STRUCTURE FOR THE ADJUSTING MOTOR OF AN ELECTRIC CAMSHAFT ADJUSTER

(75) Inventors: Jens Schäfer, Herzogenaurach (DE); Martin Steigerwald, Erlangen (DE); Martin Overberg, Herzebrock (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/015,520

(22) Filed: Dec. 17, 2004

(65) Prior Publication Data

US 2005/0103298 A1 May 19, 2005

Related U.S. Application Data

(63) Continuation of application No. PCT/EP2003/006956, filed on Jul. 1, 2003.

(30) Foreign Application Priority Data

Jul. 11, 2002 (DE) ..... 102 31 225

(51) Int. Cl.
*F01L 1/34* (2006.01)

(52) U.S. Cl. ..... 123/90.15; 123/90.17; 123/90.11; 123/90.31; 123/90.16; 74/568 R; 464/160

(58) Field of Classification Search ..... 123/90.15, 123/90.16, 90.17
See application file for complete search history.

(56) References Cited

U.S. PATENT DOCUMENTS

| | | | | |
|---|---|---|---|---|
| 3,978,829 | A * | 9/1976 | Takahashi et al. | 123/90.15 |
| 4,986,801 | A * | 1/1991 | Ohlendorf et al. | 475/331 |
| 5,417,187 | A * | 5/1995 | Meyer et al. | 123/90.17 |
| 5,680,834 | A * | 10/1997 | Szpak et al. | 123/90.15 |
| 5,787,848 | A * | 8/1998 | Stefanopoulou et al. | 123/90.15 |
| 6,655,345 | B1 * | 12/2003 | Ogawa et al. | 123/295 |
| 2004/0031455 | A1 * | 2/2004 | Muraji | 123/90.15 |

FOREIGN PATENT DOCUMENTS

| | | |
|---|---|---|
| DE | 197 46 529 | 4/1999 |
| DE | 198 04 942 | 8/1999 |
| DE | 100 36 275 | 2/2002 |
| DE | 100 38 354 | 2/2002 |
| DE | 201 14 466 | 2/2002 |
| DE | 696 20 566 | 9/2002 |
| DE | 101 16 707 | 10/2002 |

* cited by examiner

*Primary Examiner*—Thomas Denion
*Assistant Examiner*—Kyle M. Riddle
(74) *Attorney, Agent, or Firm*—Volpe and Koenig, P.C.

(57) ABSTRACT

A control structure for the adjusting motor (8) of an electric camshaft adjuster (6) in an internal combustion engine (1) is provided. The control structure includes a controller (19) which processes measuring signals of the internal combustion engine (1) to control data for the adjusting motor (8). A controller (19) which has meaningful values for the adjusted setpoint rotational speed of the adjusting motor (8), even when the input differential signal has a zero value, is obtained by applying the signal of an uncontrolled rotational speed (21) to the output signal (20) of a controlled setpoint rotational speed.

7 Claims, 3 Drawing Sheets

CONTROL STRUCTURE FOR THE ADJUSTING MOTOR OF AN ELECTRIC CAMSHAFT ADJUSTER

CROSS-REFERENCE TO RELATED APPLICATIONS

This application is a continuation of PCT/EP2003/006956, filed Jul. 1, 2003.

BACKGROUND

The invention relates to a control structure for achieving the desired adjusted rotational speed in an adjusting motor of an electric adjustment device for the camshaft of an internal-combustion engine.

A primary demand on an ideal camshaft adjuster is to guarantee the exact retention of a desired adjustable angular position course of the camshaft. However, in reality deviations arise between the desired and actual adjustable angular positions. These deviations are due to mechanical and electrical inertia, as well as the influence of interfering parameters, such as the camshaft torque.

Reducing the deviations from the desired adjustable angular position course of the camshaft leads to a reduction of pollutant emissions and fuel consumption, to an increase of motor output and torque, and also to a reduction of the onboard power load and the high emission values in the startup phase. The latter assumes that the camshaft adjuster can be controlled just before or during the startup of the engine. This challenge can be met only by an electric camshaft adjuster, because hydraulic adjusters cannot function before and during the startup phase due to the lack of lubricating-oil pressure.

One demand on an electrical camshaft adjuster is for minimal energy consumption of the electrical adjusting motor through a corresponding configuration of the controller. The quality of the controlled system is determined by the profiles of the desired-actual adjusted angles of the camshaft. The quality is increased by minimizing the deviations from the desired adjusted angle.

U.S. Pat. No. 5,787,848 B1 discloses a control structure for achieving the desired adjusted rotational speed in an adjusting motor of an electrical adjusting device for the camshaft of an internal-combustion engine. In this publication, the camshaft adjuster has at least one controller, which generates control signals for the adjusting motor from measurement signals of the internal-combustion engine. This publication concerns the control of internal exhaust-gas recirculation by changing the valve control timing. The exhaust-gas recirculation decreases the torque of the internal-combustion engine. To a achieve a torque curve similar to that of an internal-combustion engine without exhaust-gas recirculation, a low-pass filter is provided in the controller, which should prevent the original torque curve from being exceeded or undershot in sections.

SUMMARY

The invention is based on the objective of creating a control structure for the electrical adjusting motor of a camshaft adjuster, which exhibits a deviation of the actual adjusted angle from the desired adjusted angle that is as small as possible for the camshaft and low power consumption for the adjusting motor within the entire operating range.

This problem is solved according to the invention by providing a control structure for achieving the desired adjusted rotational speed in an adjusting motor of an electric camshaft adjuster for the camshaft of an internal combustion engine, in which the camshaft adjuster has at least one controller, which generates control signals for the adjusting motor from measurement signals of the internal-combustion engine. The input signal of the controller is a difference signal from desired and actual values and its output signal is a controlled desired adjusted rotational speed signal defined for the adjusting motor (8), to which an uncontrolled rotational speed signal is added.

Because the input signal is a difference signal, as the actual and desired values get closer, this difference signal approaches the value 0. This also applies to the output signal, which supplies a controlled desired adjusted rotational speed of the adjusting motor, which then comes to a standstill. However, if the camshaft is to be held in a certain position according to its angle of rotation, the adjusting motor must rotate at the camshaft rotational speed. A stationary adjusting motor leads to an adjustment of the position of the angle of rotation of the camshaft, whose adjusting speed increases with the rotational speed of the internal-combustion engine.

According to the invention, by adding the uncontrolled rotational speed signal, which is thus independent of the difference signal, the necessary desired rotational speed is set for the adjusting motor when the internal-combustion engine is operating. Therefore, the position of the camshaft relative to the crankshaft can be maintained.

For high control quality, it is advantageous to provide position control, which refers to the camshaft adjusted angle, and also rotational speed control, which refers to the adjusting motor rotational speed. In this way, the relevant parameters of the camshaft adjusted angle and the adjusting motor rotational speed are taken into account for the position of the angle of rotation of the camshaft.

It is advantageous that P, PI, PID, prediction, or observer controllers, among other kinds, can be used as the controller for the position and rotational speed control. Operating point-dependent combinations of the controllers mentioned above are also possible. Thus, for example, for small deviations in the desired-actual adjusted angles, a PI controller is advantageous and for large deviations in the desired-actual adjusted angles, a P controller is advantageous. Fuzzy-logic controllers are also conceivable.

One advantage of the prediction controller is that, depending on the appropriate adjusted angle jump of the camshaft, this sets an adjusted rotational speed that can be delayed by the adjusting motor just in the available time period. In this way, the rotational angle of the camshaft is not exceeded and therefore adjustment energy is saved.

For a monitoring controller, it is advantageous that a model of the control strategy is calculated in parallel to the controller. This model uses the controller output parameters and attempts to follow the real paths. Therefore, the control quality is improved and likewise adjustment energy is saved.

According to the desired control quality, the prediction controller for the position control and the PID controller for the rotational speed control are used individually or connected in series.

One advantageous configuration of the invention is that for position control, the input signal for the prediction controller is the difference signal between an actual adjusted angle and a desired adjusted angle of the camshaft and its output signal is a controlled desired adjusted rotational speed for the adjusting motor and that the added rotational speed is the camshaft rotational speed. The added camshaft rotational speed prevents a stationary adjusting motor and thus faulty control within the entire operating range of the internal-combustion engine.

Likewise, it is advantageous that for rotational speed control, the input signal for the PID controller is the difference signal between an actual adjusted rotational speed and a desired adjusted rotational speed of the adjusting motor and its output signal is a controlled desired adjusted rotational speed for the adjusting motor in the form of a voltage value or a pulse-duty-factor modulated voltage and that the added rotational speed is the uncontrolled and voltage-converted desired adjusted rotational speed of the adjusting motor. Here, the added, uncontrolled desired adjusted rotational speed of the adjusting motor, in which the camshaft rotational speed is contained, also prevents a stationary adjusting motor and the associated faulty control.

In one advantageous improvement of the invention, for a series circuit of the prediction controller and the PID controller, the output signal of the prediction controller with added camshaft rotational speed in voltage-converted form also acts as the switching signal for the output signal of the PID controller. Because the camshaft rotational speed is added to the output signals of both controllers, in this case a stationary adjusting motor is also reliably prevented.

The life of the controller is aided if preferably the PID controller for the rotational speed control has a current-limiting function, preferably a two-position current regulator. The current regulator decreases the voltage or the pulse-duty-factor modulated voltage when the given current limiting value is exceeded, which reduces the current. When the current falls below the current limiting value, the current regulation acts in the opposite direction.

Cost savings are realized when the position of the angle of rotation of the camshaft can be measured not by a camshaft sensor but instead by a Hall sensor of the adjusting motor. Because the stator of a brushless DC motor already has at least one Hall sensor, a special camshaft sensor is unnecessary.

BRIEF DESCRIPTION OF THE DRAWINGS

Additional features of the invention are provided in the following description and the drawings, in which several embodiments of the invention are shown schematically. In the drawings.

DETAILED DESCRIPTION OF THE PREFERRED EMBODIMENTS

Figure 1:
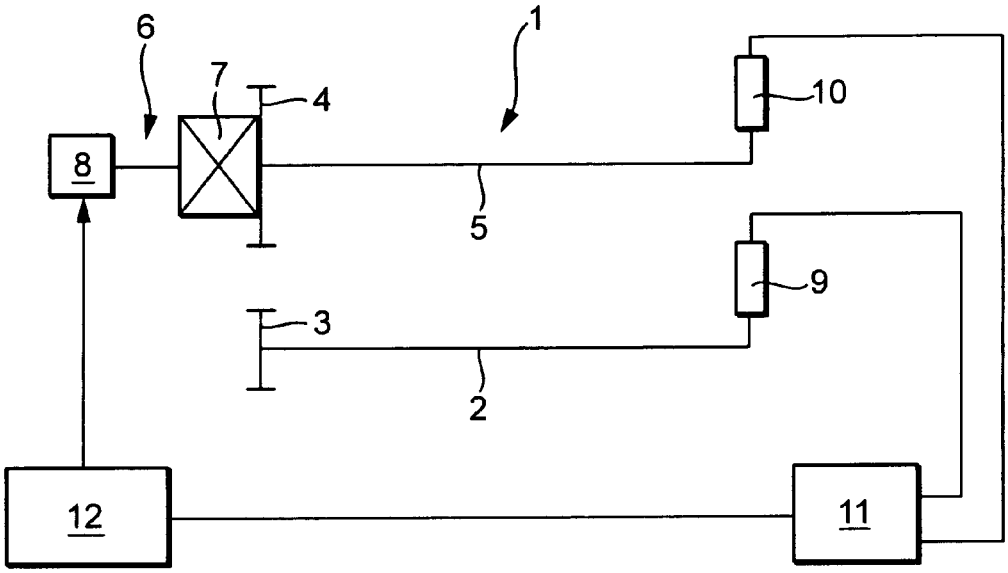
FIG. 1 is a schematic of an electric camshaft adjuster with control electronics and separate camshaft sensor.

In FIG. 1, an internal-combustion engine 1 is shown schematically. Its crankshaft 2 drives a camshaft drive wheel 4 of a camshaft 5 at the ratio of 2:1 nCK/nCM via a crankshaft drive wheel 3 by means of a not shown chain or toothed belt. The camshaft 5 has an electric camshaft adjuster 6 with an adjusting gear unit 7 and an electric adjusting motor 8. The position of the angle of rotation of the crankshaft 2 is measured by a crankshaft sensor 9. The position of the angle of rotation of the camshaft 5 is measured by a camshaft sensor 10. The signals of the sensors 9, 10 are led via a controller 11 of the internal-combustion engine 1 to a controller 12 of the adjusting motor 8. There, they are converted into control signals for the adjusting motor 8.

Figure 2:
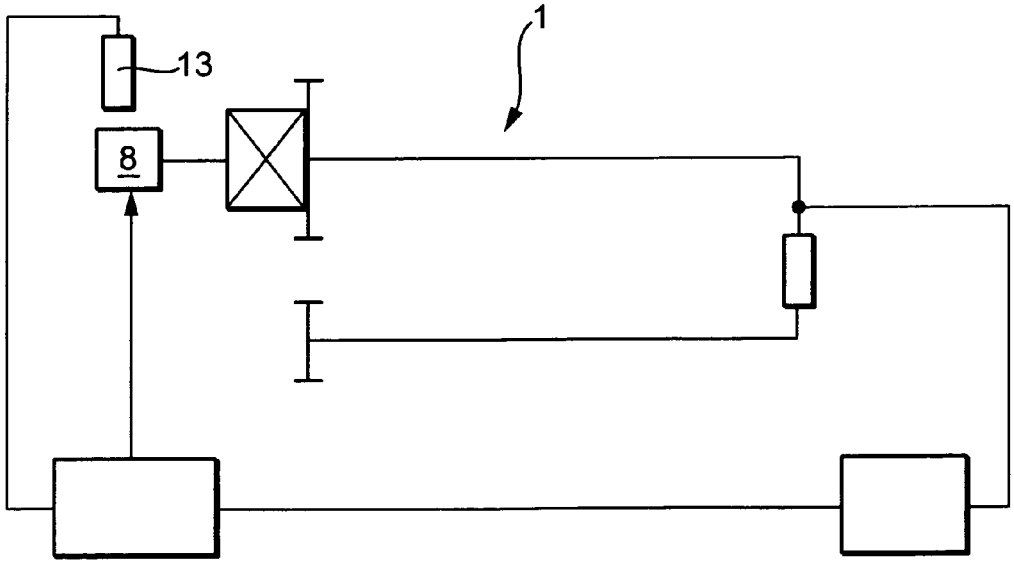
FIG. 2 is a view similar to the schematic of FIG. 1, but with a Hall sensor of the adjusting motor instead of the camshaft sensor.

FIG. 2 shows the schematic of the internal-combustion engine 1 of FIG. 1, but the camshaft sensor 10 has been replaced by a Hall sensor 13, which is provided anyway in brushless DC motors, for the adjusting motor 8.

Figure 3:
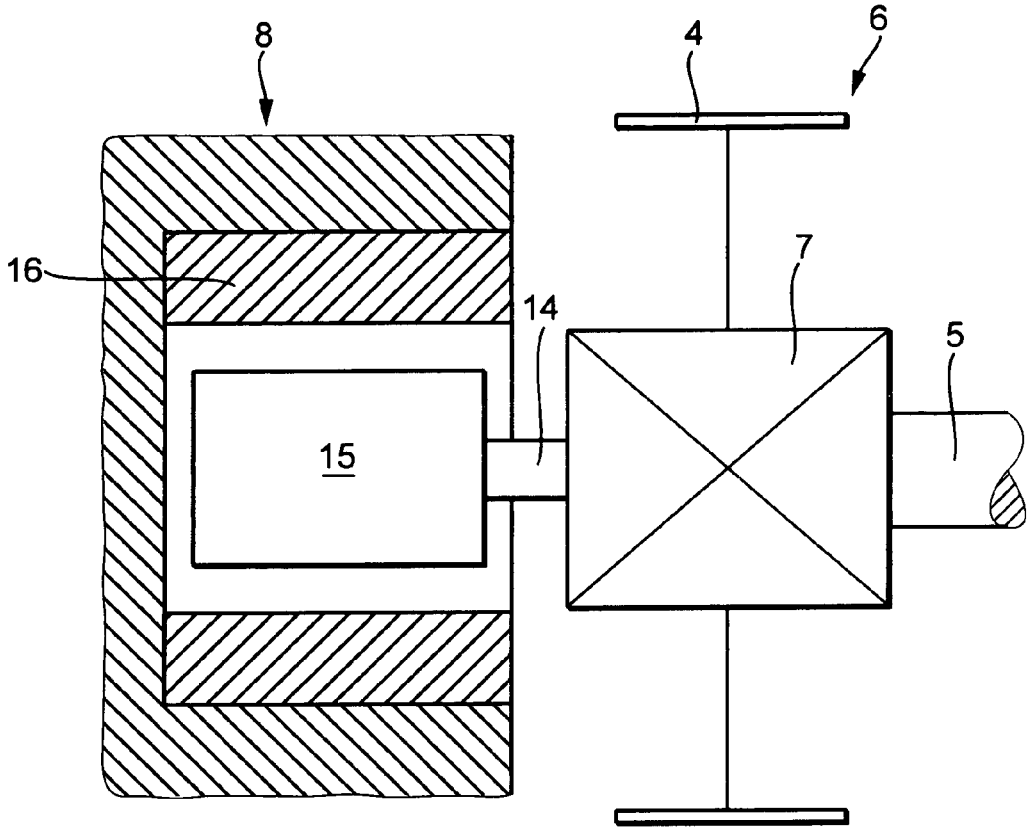
FIG. 3 is a view of a camshaft adjuster with a housing-fixed stator of the electrical adjusting motor.

In FIG. 3, the camshaft adjuster 6 is shown schematically. The adjusting gear unit 7 is configured as a triple-shaft gear system, with a drive shaft, which is connected to the camshaft drive wheel 4, a driven shaft, which is connected to the camshaft 5, and an adjusting shaft 14, which is connected to a rotor 15 of the adjusting motor 8. The adjusting motor 8 has a stator 16, which is provided fixed to the housing.

Figure 4:
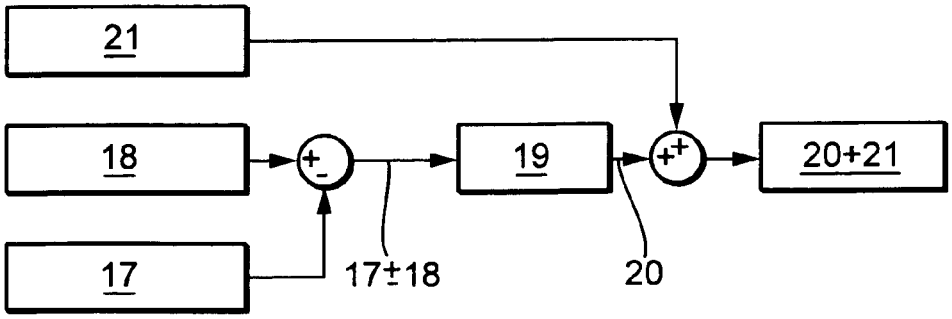
FIG. 4 is a view of a control structure for position control with a PID controller and adding of the camshaft rotational speed to its output signal.

FIG. 4 represents the control structure according to the invention. A difference signal 17±18 of an actual adjusted angle 17 and a desired adjusted angle 18 between the crankshaft 2 and the camshaft 5 is the input signal of a PID controller 19. Its output signal 20 includes a controlled desired adjusted rotational speed for the adjusting motor 8.

When the actual and desired adjusted angles 17, 18 approach each other, the difference signal 17±18 approaches the value 0. Therefore, the output signal 20 and thus the controlled desired adjusted rotational speed of the adjusting motor 8 also approaches this value.

When the position of the angle of rotation of the camshaft 5 is to be maintained, the rotor 15 of the adjusting motor 8 must rotate at the camshaft rotational speed. Deviations from this rotational speed have the effect of considerable deviations in the control position, especially at higher rotational speeds of the internal-combustion engine 1.

This situation is prevented in that according to the invention, the camshaft rotational speed 21 is added to the output signal 20 of the controller 19 and thus is set for the adjusting motor 8 as the desired adjusted rotational speed 20+21. In this way, the adjusting motor 8 rotates at least with the camshaft rotational speed 21, whereby the control position of the camshaft 5 is maintained.

Despite the improved control behavior by applying the camshaft rotational speed 21 to the output signal 20 of the PID controller 19, this arrangement leads to great overshooting of the adjusted angle at the end of each rotational speed jump of the adjusting motor 8. This is important essentially because it is not quick enough to be able to follow the settings of the desired adjusted rotational speed, because acceleration and delay processes cannot be performed quickly enough due to its limited torque capacity.

Figure 5:
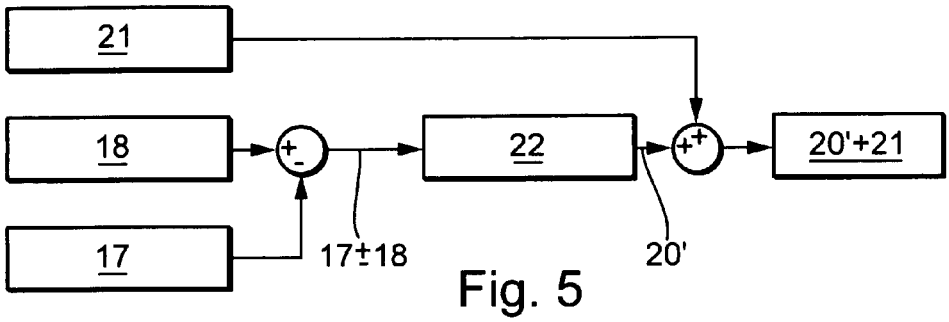
FIG. 5 shows the control structure for position control with a prediction controller and adding of the camshaft rotational speed to its output signal.

This behavior can be improved with a so-called prediction controller 22, which FIG. 5 shows in the control structure for position control. Depending on the size of the jump of the adjusted angle, this sets an adjusted rotational speed that can be delayed by the adjusting motor 8 just in the available time.

The size of the input signal 17±18 of the prediction controller 22 corresponds to the difference of the actual adjusted angle 17 and the desired adjusted angle 18 of FIG. 4. Depending on this adjusted angle jump, the particular controlled desired adjusted rotational speed, which can be delayed by the adjusting motor 8 for overcoming the given angular deviation within the available time, is given by the prediction controller 22 as output signal 20'.

The current camshaft rotational speed 21 is applied to the output signal 20' of the prediction controller 22 and the sum 20'+21 is set for the adjusting motor 8 as the desired adjusted rotational speed. The exceeding of the actual adjusted angle is prevented by the prediction controller 22 and therefore the power consumption of the adjusting motor 8 is also considerably reduced.

Figure 6:
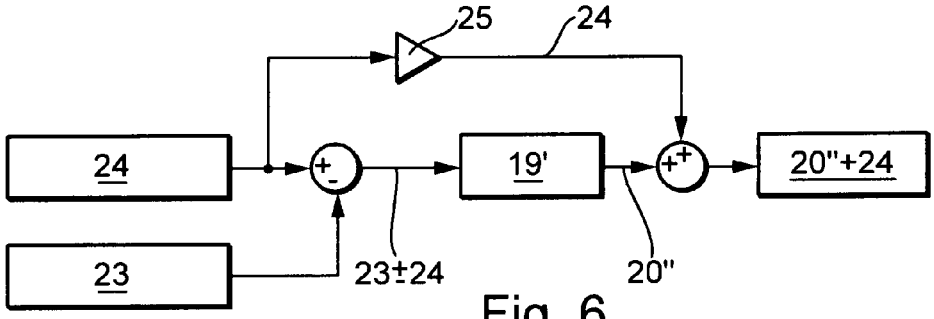
FIG. 6 is a view with a control structure for rotational speed control with a PID controller and adding of a voltage or pulse-duty-factor modulated voltage of an uncontrolled desired adjusted rotational speed of the adjusting motor to the output signal of the PID controller.

The previously described controllers 19, 22 are used for position control of the camshaft 5. For optimum control results, an internal control loop with rotational speed control or alternatively current or torque control of the adjusting motor 8 is still necessary. FIG. 6 shows the relevant control structure.

The input signal of the PID controller 19' is the difference signal 23±24 between a desired adjusted rotational speed 24 and an actual adjusted rotational speed 23 of the adjusting motor 8. As the output signal 20", one obtains a voltage, which is used for controlling the adjusting motor 8. To prevent a voltage of 0 from being set when the desired and actual adjusted rotational speeds 24, 23 agree, the voltage corresponding to the desired adjusted rotational speed 24 of the adjusting motor 8 is added to the output signal 20" by means of a voltage converter 25. This guarantees that a voltage corresponding to the desired adjusted rotational speed 24 is always set for the adjusting motor 8 during operation. In addition to the PID controller, the controller can also be a P, PI, or prediction controller, among other kinds.

There are no remaining control deviations for a rotational speed control. In addition, the adjusted speeds are higher than for the position control.

Figure 7:
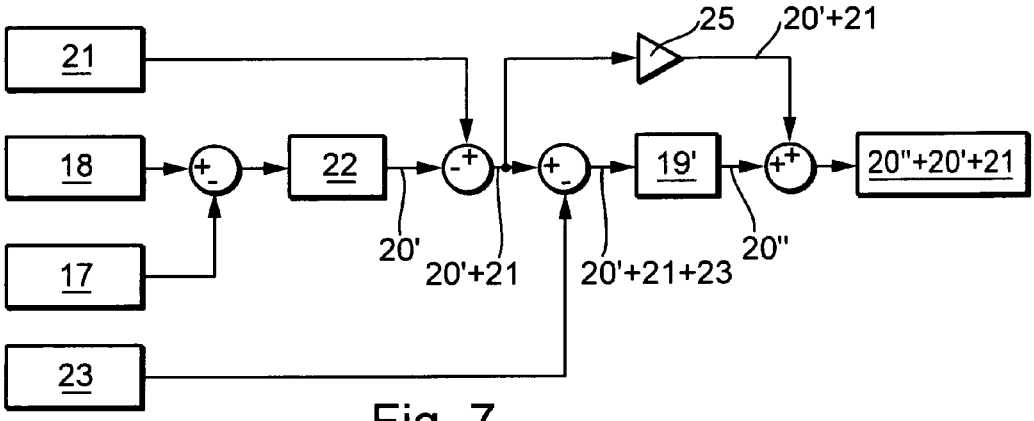
FIG. 7 is a view of a control structure for position and rotational speed control with a prediction and a PID controller and applying a rotational speed as well as a voltage to the appropriate output signal.

FIG. 7 shows the control structure of a complete control system for the adjusting motor 8 with series connection of a position control corresponding to FIG. 4 and a rotational speed control corresponding to FIG. 6. The position control has a prediction controller 22, whose input signal is formed as the difference signal 17±18 between the actual adjusted angle 17 and the desired adjusted angle 18 and is processed into the output signal 20' of a controlled desired adjusted rotational speed. The camshaft rotational speed 21 is added to this value, which together form the desired adjusted rotational speed 20'+21 of the adjusting motor 8.

The difference signal 20'+21±23 from the desired adjusted rotational speed 20'+21 and actual adjusted rotational speed 23 forms the input signal of the PID controller 19' of the rotational speed control, whose output signal 20" is processed with the added desired adjusted rotational speed 20'+21 voltage-converted in a voltage converter 25 into the voltage 20"+20'+21 controlling the adjusting motor 8. In addition to the illustrated prediction and PID controllers 22, 19', among other things, other controllers such as P and PI controllers can also be used.

It is further conceivable, at least in the PID controller 19' of the rotational speed control, to integrate a current limiting function for protecting the adjusting motor 8 and the control electronics, for example, a two-position current regulator, which decreases the voltage or the pulse duty factor when the set current limiting value is exceeded.

Figure 8:
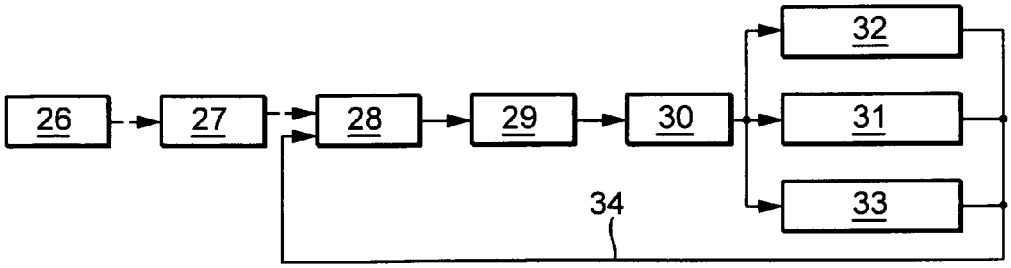
FIG. 8 is a flow chart for the motor startup and the driving operation.

In FIG. 8, a flow chart is shown, which shows how the control of the adjusting motor 8 is realized during the startup of the internal-combustion engine 1 and during its operation. In position 26, the ignition is activated. In position 27, the starter runs up and thus the startup process ends. In position 28, the rotational angle position of the camshaft 5 is recognized. In position 29, the adjusted angle comparison is activated and the result of this comparison leads to the control of the adjusting motor 8 in position 30. Control can mean holding according to position 31, advance adjustment according to position 32, or retard adjustment according to position 33. The appropriate result is fed back via the return line 34 to position 28, which begins a new cycle.

LIST OF REFERENCE SYMBOLS

1 Internal-combustion engine
2 Crankshaft
3 Crankshaft drive wheel
4 Camshaft drive wheel
5 Camshaft
6 Camshaft adjuster
7 Adjusting gear unit
8 Adjusting motor
9 Crankshaft sensor
10 Camshaft sensor
11 Controller
12 Controller
13 Hall sensor
14 Adjusting shaft
15 Rotor
16 Stator
17 Actual adjusted angle
18 Desired adjusted angle
19, 19' PID controller
20, 20', 20" Controlled output signal
21 Camshaft rotational speed
22 Prediction controller
23 Actual adjusted rotational speed
24 Desired adjusted rotational speed
25 Voltage converter
26 Position "Turn ignition"
27 Position "Starter runs up"
28 Position "Position of the angle of rotation of the camshaft"
29 Position "Desired-actual adjusted angle comparison"
30 Position "Control of the adjusting motor"
31 Position "Holding"
32 Position "Advance adjustment"
33 Position "Retard adjustment"
34 Return line

The invention claimed is:

1. A control structure of an electric camshaft adjuster (6) for achieving a desired adjusted rotational speed in an adjusting motor (8) for a camshaft (5) of an internal combustion engine (1), the control structure comprising: at least one controller (19, 22, 19') which generates control signals for the adjusting motor (8) from measurement signals of the internal-combustion engine (1), an input signal of the controller (19, 22, 19') is a difference signal derived from a desired and an actual value and an output signal is a controlled desired adjusted rotational speed signal defined for the adjusting motor (8), to which an uncontrolled rotational speed signal is added, the at least one controller further including a position control, which refers to the camshaft adjusted angle, and a rotational speed control, which refers to the adjusting motor rotational speed, wherein the position control and rotational speed control comprise at least one of a P, PI, PID, prediction and monitoring controller, and the at least one controller further including a prediction controller (22) that sets an adjusted rotational speed that can be delayed by the adjusting motor (8) in an available time period, depending on an appropriate adjusted angle jump of the camshaft (5).

2. Control structure according to claim 1, wherein for the position control the prediction controller (22) is provided and for the rotational speed control the PID controller (19') is provided, which can be used individually or connected in series.

3. Control structure according to claim 2, wherein for position control, the input signal of the prediction controller (22) is the difference signal (17±18) between an actual adjusted angle (17) and a desired adjusted angle (18) of the camshaft (5) and the output signal (20') is a controlled desired adjusted rotational speed for the adjusting motor (8) and that the added rotational speed is the camshaft rotational speed (21).

4. Control structure according to claim 2, wherein for rotational speed control, the input signal of the PID controller (19') is the difference signal (23±24) between an actual adjusted rotational speed (23) and a desired adjusted rotational speed (24) of the adjusting motor (8) and the output signal (20") is a controlled desired adjusted rotational speed for the adjusting motor (8) in the form of a voltage value or a pulse-duty-factor modulated voltage and that the added rotational speed is an uncontrolled and voltage-conerted desired adjusted rotational speed (24) of the adjusting motor (8).

5. Control structure according to claim 2, wherein for a series connection of the prediction controller (22) and the PID controller (19'), the output signal (20') of the prediction controller (22) with added camshaft rotational speed (21) in the voltage-converted form is also used as an application signal (20'+21) for the output signal (20") of the PID controller (19').

6. Control structure according to claim 5, wherein the PID controller (19') of the rotational speed control has a current limiting function comprising a two-position current regulator.

7. Control structure according to claim 1, wherein the position of the angle of rotation of the camshaft (5) can be measured by a camshaft sensor (10) or by a Hall sensor (13) of the adjusting motor (8).

* * * * *